US008940104B2

(12) United States Patent
Zhong et al.

(10) Patent No.: US 8,940,104 B2
(45) Date of Patent: Jan. 27, 2015

(54) CLEANING COMPOSITION FOR TEMPORARY WAFER BONDING MATERIALS

(75) Inventors: Xing-Fu Zhong, Rolla, MO (US); John Moore, Camarillo, CA (US)

(73) Assignee: Brewer Science Inc., Rolla, MO (US)

( * ) Notice: Subject to any disclaimer, the term of this patent is extended or adjusted under 35 U.S.C. 154(b) by 678 days.

(21) Appl. No.: 13/196,679

(22) Filed: Aug. 2, 2011

(65) Prior Publication Data

US 2013/0032296 A1 Feb. 7, 2013

(51) Int. Cl.

| | |
|---|---|
| ***B08B 3/04*** | (2006.01) |
| ***C11D 1/22*** | (2006.01) |
| ***C11D 3/20*** | (2006.01) |
| ***C11D 3/43*** | (2006.01) |
| ***B08B 3/02*** | (2006.01) |

(52) U.S. Cl.

CPC ..... *C11D 3/2003* (2013.01); *B08B 3/024* (2013.01); *B08B 3/04* (2013.01); *B08B 3/041* (2013.01); *C11D 1/22* (2013.01); *C11D 3/43* (2013.01); *C11C 11/0047* (2013.01)

USPC ..... 134/42; 134/39; 510/175; 510/176; 510/178; 510/426; 510/495

(58) Field of Classification Search

CPC ..... C11D 1/12; C11D 3/2003; C11D 3/006; C11D 3/2041; C11D 3/3418; B08B 3/024; B08B 3/04; B08B 3/041

USPC ..... 510/175, 176, 178, 426, 495; 134/39, 134/42

See application file for complete search history.

(56) References Cited

U.S. PATENT DOCUMENTS

| | | | | |
|---|---|---|---|---|
| 4,165,295 | A | 8/1979 | Vander Mey | |
| 4,215,005 | A * | 7/1980 | Vander Mey | 510/176 |
| 6,660,460 | B2 * | 12/2003 | Sahbari | 430/331 |
| 7,183,245 | B2 | 2/2007 | Moore | |
| 7,713,835 | B2 | 5/2010 | Pillalamarri | |
| 7,935,780 | B2 | 5/2011 | Hong et al. | |
| 8,324,143 | B2 * | 12/2012 | Suzuki et al. | 510/175 |
| 2008/0200011 | A1 | 8/2008 | Pillalamarri et al. | |
| 2009/0218560 | A1 | 9/2009 | Flaim et al. | |
| 2010/0112305 | A1 | 5/2010 | Hong et al. | |
| 2010/0167972 | A1 * | 7/2010 | Kawase et al. | 510/175 |
| 2010/0279910 | A1 * | 11/2010 | Lee | 510/176 |
| 2011/0247660 | A1 * | 10/2011 | Lee | 134/26 |
| 2011/0308739 | A1 | 12/2011 | McCutcheon et al. | |

* cited by examiner

*Primary Examiner* — Gregory R Delcotto
(74) *Attorney, Agent, or Firm* — Hovey Williams LLP

(57) ABSTRACT

A cleaning composition for removing temporary wafer bonding material is provided. The cleaning composition comprises an alkylarylsulfonic acid and an aliphatic alcohol dispersed or dissolved in a hydrocarbon solvent system. Methods of separating bonded substrates and cleaning debonded substrates using the cleaning composition are also provided. The invention is particularly useful for temporary bonding materials and adhesives. The methods generally comprise contacting the bonding material with the cleaning solution for time periods sufficient to dissolve the desired amount of bonding material for separation and/or cleaning of the substrates.

23 Claims, 3 Drawing Sheets

CLEANING COMPOSITION FOR TEMPORARY WAFER BONDING MATERIALS

BACKGROUND OF THE INVENTION

1. Field of the Invention

The present invention relates to cleaning methods and compositions for debonding and/or cleaning debonded substrates, such as substrates used in temporary wafer bonding processes.

2. Description of Related Art

During the manufacture of three-dimensional (3-D) integrated semiconductor microcircuits, it is often necessary to temporarily bond a device wafer to a carrier wafer with an adhesive so that the device wafer can undergo grinding, thinning, photolithography, chemical vapor deposition (CVD), and/or other processes. After all the necessary processing steps are completed, the device wafer is then separated, or debonded, from the carrier wafer. Debonding of a device wafer from the carrier following backside processing can be typically performed by various processes such as:

(1) Chemical—The bonded wafer stack is immersed in, or sprayed with, a solvent or chemical agent to dissolve or decompose the bonding material.

(2) Photodecomposition—The bonded wafer stack is irradiated with a light source through a transparent carrier to photodecompose the bonding material adjacent to the carrier.

(3) Thermomechanical—The bonded wafer stack is heated above the softening temperature of the bonding material, and the device wafer is then slid, pulled, or peeled away from the carrier while being supported with a full-wafer holding chuck.

(4) Thermodecomposition—The bonded wafer stack is heated above the decomposition temperature of the bonding material, causing it to volatilize and lose adhesion to the device wafer and carrier.

Regardless of the method, residual bonding material must generally be cleaned from the device wafer prior to the next processing step. Furthermore, sometimes-expensive carrier wafers must be cleaned for reuse. Conventional hydrocarbon solvents that dissolve the temporary adhesives do not clean effectively because they leave too much residue, as do conventional solvents used for chemical separation of the substrates in the first place. Strong acidic or alkaline solutions such as concentrated sulfuric acid/hydrogen peroxide (Nano-Strip or Piranha solution) and RCA cleaning solutions may effectively clean the wafers, but they are corrosive and can attack metallic circuits or pads. Thus, there remains a need in the art for improved cleaning solutions for separating and cleaning temporarily bonded substrates.

SUMMARY OF THE INVENTION

The present invention is broadly concerned with methods of removing bonding materials from a substrate and compositions useful for removing bonding materials or adhesives, especially temporary wafer bonding materials. In one aspect, there is provided a method of cleaning a substrate surface. The method comprises providing a substrate having a surface with a bonding material thereon and contacting the bonding material with a cleaning composition to thereby remove at least a portion of the bonding material from the substrate surface. The cleaning composition comprises an alkylarylsulfonic acid and an aliphatic alcohol dispersed or dissolved in a hydrocarbon solvent system.

In a further aspect, a method of removing a bonding material from a substrate is provided. The method comprises providing a stack comprising first and second substrates bonded together via a layer of a bonding material; and contacting the bonding material with a cleaning composition to thereby remove at least a portion of the layer of bonding material. The cleaning composition comprises an alkylarylsulfonic acid and an aliphatic alcohol dispersed or dissolved in a hydrocarbon solvent system.

In yet another aspect of the invention, there is provided a microelectronic structure. The structure comprises a substrate having a surface; a quantity of bonding material adjacent the substrate surface; and a cleaning composition adjacent the bonding material. The cleaning composition comprises an alkylarylsulfonic acid and an aliphatic alcohol dispersed or dissolved in a hydrocarbon solvent.

In a further aspect, a cleaning composition for removing temporary wafer bonding material is provided. The cleaning composition comprises an alkylarylsulfonic acid and an aliphatic alcohol dispersed or dissolved in a hydrocarbon solvent.

BRIEF DESCRIPTION OF THE DRAWINGS

FIG. 1(*b*) is a schematic cross-sectional view of a debonded wafer stack of FIG. 1(*a*);

FIG. 2(*b*) is a schematic cross-sectional view of the wafer stack from FIG. 2(*a*) after edge removal;

FIG. 3(*b*) is a schematic cross-sectional view of the wafer stack from FIG. 3(*a*) after edge removal.

Figure 1:
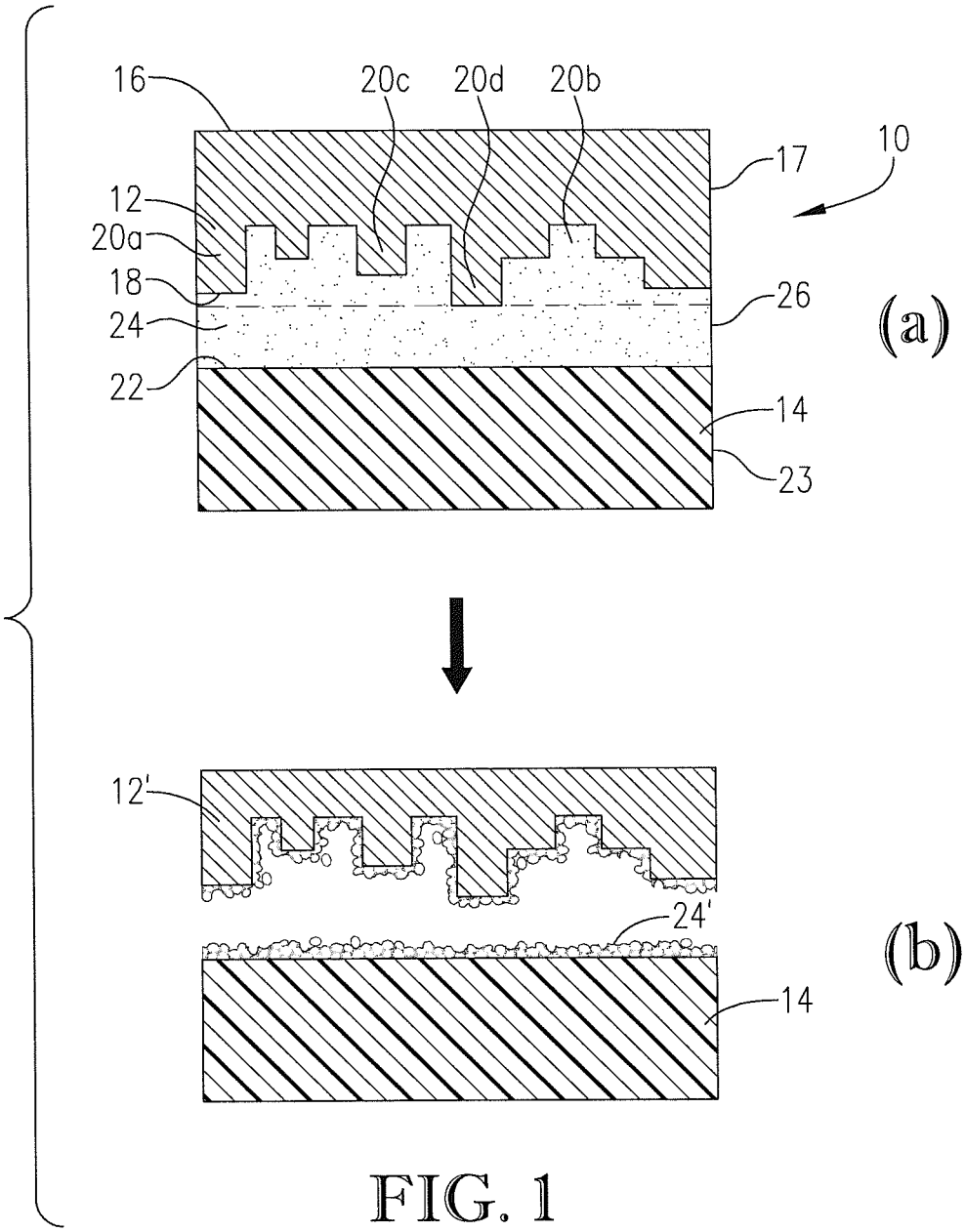
FIG. 1(*a*) is a schematic cross-sectional view of a wafer stack in accordance with the invention.

While the drawings illustrate, and the specification describes, certain preferred embodiments of the invention, it is to be understood that such disclosure is by way of example only. Embodiments of the present invention are described herein with reference to cross-section illustrations that are schematic illustrations of idealized embodiments of the present invention. As such, variations from the shapes of the illustrations as a result of for example, manufacturing techniques and/or tolerances, are to be expected. There is no intent to limit the principles of the present invention to the particular disclosed embodiments. For example, in the drawings, the size and relative sizes of layers and regions may be exaggerated for clarity and are not shown to scale. In addition, embodiments of the present invention should not be construed as limited to the particular shapes of regions illustrated herein but are to include deviations in shapes that result, for example, from manufacturing. For example, a topographical region illustrated as a rectangle may have rounded or curved features. Thus, the regions illustrated in the figures are schematic in nature and their shapes are not intended to illustrate the precise shape of a region of a device and are not intended to limit the scope of the present invention.

DETAILED DESCRIPTION

In more detail, the present invention is concerned with new cleaning solutions and cleaning methods, especially suited for removing temporary wafer bonding materials from microelectronic substrates. The cleaning composition comprises an alkylarylsulfonic acid and an aliphatic alcohol dispersed or dissolved in a hydrocarbon solvent system. Suitable alkylarylsulfonic acids for use in the invention will include $C_1$-$C_{18}$ alkyl groups, but preferably contain longer chain alkyl groups such as $C_6$-$C_{18}$alkyls, and more preferably $C_8$-$C_{12}$ alkyls. Suitable alkylarylsulfonic acids will also include $C_6$-$C_{22}$ aryls, more preferably $C_6$-$C_{16}$ aryls, and even more preferably $C_6$-$C_{10}$ aryls. Exemplary aryl groups are selected from the group consisting of benzene, naphthalene, and anthracene, with alkylbenzenesulfonic acid being particularly preferred. Specific examples of suitable alkylbenzenesulfonic acids include those selected from the group consisting of hexylbenzenesulfonic acid, heptylbenzenesulfonic acid, octylbenzenesulfonic acid, decylbenzenesulfonic acid, dodecylbenzenesulfonic acid, tridecylbenzenesulfonic acid, tetradecylbenzenesulfonic acid, hexadecylbenzenesulfonic acid, and octadecylbenzenesulfonic acid. Mixtures of two or more alkylarylsulfonic acids could also be used in the inventive compositions. The composition preferably comprises from about 2% to about 15% by weight alkylarylsulfonic acid, more preferably from about 3% to about 10% by weight alkylarylsulfonic acid, and even more preferably from about 5% to about 10% by weight alkylarylsulfonic acid, based upon the total weight of the composition taken as 100% by weight.

Suitable aliphatic alcohols for use in the inventive compositions include $C_1$-$C_8$ aliphatic alcohols, preferably $C_1$-$C_6$ aliphatic alcohols, and more preferably $C_2$-$C_4$ aliphatic alcohols. Exemplary aliphatic alcohols for use in the inventive composition include those selected from the group consisting of ethanol, 1-propanol, 2-propanol (isopropanol), 1-butanol, 2-butanol, 2-methyl-1-propanol and 2-methyl-2-propanol, allyl alcohol, 2-butyn-1-ol, 3-butyn-1-ol, 3-butyn-2-ol, 3-buten-1-ol, 3-buten-2-ol, 1-pentanol, 2-pentanol, and 1-hexanol. Mixtures of two or more aliphatic alcohols could also be used in the inventive compositions. The composition preferably comprises from about 2% to about 15% by weight aliphatic alcohol, more preferably from about 3% to about 10% by weight aliphatic alcohol, and even more preferably from about 5% to about 10% by weight aliphatic alcohol, based upon the total weight of the composition taken as 100% by weight.

Suitable hydrocarbon solvents for use as the solvent system include $C_6$-$C_{16}$ hydrocarbon solvents, $C_6$-$C_{12}$ hydrocarbon solvents, and $C_8$-$C_{12}$ hydrocarbon solvents, with $C_8$-$C_1$, hydrocarbon solvents being particularly preferred. The term "hydrocarbon solvent" is used herein in accordance with its customary meaning as indicating liquid compounds consisting entirely of hydrogen and carbon (and excluding compounds that contain other elements, such as oxygen or nitrogen). Examples of suitable hydrocarbon solvents include those selected from the group consisting of hexane, cyclohexane, heptane, octane, 1-octene, decane, 1-decene, dodecane, 1-dodecene, 1-tetradecene, 1-hexadecene, 1-octadecene, toluene, xylene, mesitylene, decahydronaphthalene (Decalin), 1,2,3,4-tetrahydronaphthalene (Tetralin), naphtha, ethyl benzene, cumene, and limonene.

Mixtures of two or more hydrocarbon solvents could also be used in the inventive compositions. Preferred hydrocarbon solvents will preferably have a flash point of greater than about 100° F. Particularly preferred hydrocarbon solvents for use in the invention are selected from the group consisting of saturated hydrocarbon solvents and aromatic hydrocarbon solvents. The hydrocarbon solvent is preferably present in the composition at a level of from about 70% to about 96% by weight, more preferably from about 80% to about 94% by weight, and even more preferably from about 80% to about 90% by weight, based upon the total weight of the composition taken as 100% by weight.

The composition is formed by mixing the alkylarylsulfonic acid, aliphatic alcohol, and hydrocarbon solvent together, preferably under ambient conditions (i.e., room temperature ~20° C. and 14.7 psi). More preferably, the composition is formed by first dissolving the alkylarylsulfonic acid in the aliphatic alcohol to form a true (i.e., molecular) solution. Next, the hydrocarbon solvent is slowly added to the solution with vigorous stirring, preferably until the alkylarylsulfonic acid changes from solution form to reverse micelle form. More specifically, the hydrocarbon solvent is preferably added until the ratio of hydrocarbon solvent to aliphatic alcohol is at least about 1:1, preferably greater than about 5:1, and more preferably greater than about 15:1. Though not wishing to be bound by theory, the reverse micelles are believed to be characterized by sulfonic acid groups in the core and alkylaryl groups in the shell/corona. The concentration of aliphatic alcohol is also believed to be greater inside the reverse micelles (i.e., in the core and at the interface between the core and corona) than outside the reverse micelles.

Although other ingredients may be included in the cleaning compositions (such as ketones, alkyl halides, fatty acids, and mixtures thereof), it is preferred that the composition consist essentially (or even consist) of alkylarylsulfonic acid, aliphatic alcohol, and hydrocarbon solvent. That is, the compositions are preferably substantially free of any other ingredients. More specifically, it is preferred that the compositions be substantially free of halides, such as fluoride, chloride, etc. It is also preferred that the compositions be substantially free of alkoxybenzenes. The compositions are also substantially free of anisole. It is also preferred that the compositions be substantially free of any corrosive materials, such as strong acid or alkaline solutions (e.g., sulfuric acid, hydrogen peroxide, sodium hydroxide, potassium hydroxide, or tetramethyl ammonium hydroxide). The composition is also preferably substantially free of surfactants, such as sodium dodecyl sulfate (SDS), polyethylene glycol tert-octylphenyl ether (Triton X-100), and FC4430. It is also preferred that the compositions be substantially free of phenol. The term "substantially free," as used herein, means that the ingredient is present in the composition at a level of less than about 0.5% by weight, more preferably less than about 0.1% by weight, and even more preferably about 0% by weight, based upon the total weight of the composition taken as 100% by weight.

The cleaning composition can be used to remove temporary wafer bonding material from various substrates, such as microelectronic substrates. For example, the cleaning composition can be used to clean residual wafer bonding material from one or both substrates after separation, and/or the cleaning composition can be used to dissolve the wafer bonding material to facilitate separation of the bonded substrates in the first place. In a typical method of use, a wafer stack is provided. The stack comprises bonded substrates, and in particular, a first substrate bonded to a second substrate via a layer of bonding material. After processing, the first and second substrates are separated, for example, using the inventive cleaning composition and/or another suitable separation method described above. The separated substrates are then cleaned of residual bonding material using the inventive cleaning composition.

More specifically, FIG. 1(*a*) depicts one embodiment of a stack 10 of two reversably bonded wafers. The exemplary stack 10 comprises a first substrate 12 and a second substrate 14. In the embodiment depicted in FIG. 1(*a*), the first substrate 12 is an active or device wafer having a back surface 16, an outermost edge 17 defining the periphery (perimeter) of the substrate 12, and a device surface 18, which can comprise various topographical features 20*a*-20*d*. As used herein, "topography" refers to the height or depth of a structure in or on a substrate surface. Typical first substrates 12 can include any microelectronic substrate. Exemplary first substrates 12 in this embodiment include those is selected from the group consisting of microelectromechanical system (MEMS) devices, display devices, flexible substrates (e.g., cured epoxy substrates, roll-up substrates that can be used to form maps), compound semiconductors, low k dielectric layers, dielectric layers (e.g., silicon oxide, silicon nitride), ion implant layers, and substrates comprising silicon, aluminum, tungsten, tungsten silicide, gallium arsenide, germanium, tantalum, tantalum nitrite, SiGe, and mixtures of the foregoing. The device surfaces 18 can also comprise arrays of devices selected from the group consisting of integrated circuits, MEMS, microsensors, power semiconductors, light-emitting diodes, photonic circuits, interposers, embedded passive devices, and other microdevices fabricated on or from silicon and other semiconducting materials such as silicon-germanium, gallium arsenide, and gallium nitride. The surfaces of these devices also commonly comprise structures formed from one or more of the following materials: silicon, polysilicon, silicon dioxide, silicon (oxy)nitride, metals (e.g., copper, aluminum, gold, tungsten, tantalum), low-k dielectrics, polymer dielectrics, and various metal nitrides and silicides. The device surface 18 can also include raised structures such as solder bumps and metal posts and pillars.

The second substrate 14 in the illustrated embodiment is a carrier wafer. The second substrate 14 has a bonding surface 22 and an outermost edge 23 defining the periphery (perimeter) of the substrate 14. Typical carrier substrates 14 can comprise a material selected from the group consisting of sapphire, ceramic, glass, quartz, metals (e.g., aluminum, copper, steel, silver), silicon, various glasses and ceramics, glass-ceramic composites (such as products sold under the name Zerodur®; available from Schott AG), and combinations thereof. The second substrate 14 can also include other materials deposited on its surface 22 (not shown). For example, silicon nitride can be deposited onto a silicon wafer to change the bonding characteristics of the surface 22.

The first substrate 12 and second substrate 14 are bonded together via a layer 24 of bonding material. Bonding layer 24 can be formed from any suitable bonding material, and is preferably formed from a temporary bonding composition. The perimeter of the bonding layer 24 is defined by an outermost edge 26. It will be appreciated that the bonding layer 24 can be applied to either or both substrates 12, 14, such as by spin-coating or spray-coating. In embodiments where the first substrate 12 comprises topography, the bonding material is preferably applied to the first substrate 12 so that it flows into and over the various topographical features 20*a*-20*d*. The substrates 12, 14 are then bonded in face-to-face relationship to one another. Exemplary bonding materials include commercial temporary wafer bonding compositions such as those sold under the name WaferBOND® (available from Brewer Science Inc., Rolla, Mo.), some commercial photoresist compositions, and other resins and polymers that exhibit high adhesion strength to semiconductor materials, glass, and metals. Especially preferred bonding materials are: (1) high solids, UV-curable resin systems such as reactive epoxies and acrylics; (2) related thermosetting resin systems such as two-part epoxy and silicone adhesives; (3) thermoplastic acrylic, styrenic, vinyl halide (non-fluoro-containing), and vinyl ester polymers and copolymers along with polyamides, polyimides, polysulfones, polyethersulfones, and polyurethanes; and (4) cyclic olefins, polyolefins (e.g., polyisobutylene, polyisoprene, polyhydrocarbon), and hydrocarbon-based tackifier resins. Regardless of the embodiment, the bonding layer 24 is bonded to device surface 18 of substrate 12 as well as to bonding surface 22 of substrate 14, as shown in the FIG. 1(*a*)

The bonding layer 24 can be a uniform (chemically the same) material across its thickness and/or across the substrate surfaces 18, 22, as shown in FIG. 1(*a*). Alternatively, there can be a non-uniform material distribution across the substrates or across the thickness of the layer, as depicted in the wafer stacks of FIGS. 2(*a*) and 3(*a*), with like numbering being used for like parts. For example, a portion of the bonding layer 24 may include fill material 28. It will be appreciated that the bonding strength of the fill material 28 will depend upon its specific chemical structures and the coating and baking conditions used to apply it; however, the fill material 28 generally does not form strong (or as strong of) adhesive bonds as the bonding material. Such fill material 28 is typically formed of a material comprising monomers, oligomers, and/or polymers dispersed or dissolved in a solvent system. Examples of suitable monomers, oligomers, and/or polymers include those selected from the group consisting of cyclic olefin polymers and copolymers and amorphous fluoropolymers with high atomic fluorine content (greater than about 30% by weight) such as fluorinated siloxane polymers, fluorinated ethylene-propylene copolymers, polymers, with pendant perfluoroalkoxy groups, and copolymers of tetrafluoroethylene and 2,2-bis-trifluoromethyl-4,5-difluoro-1,3-dioxole being particularly preferred.

Exemplary methods of forming wafer stacks and various temporary bonding materials and fill materials are disclosed in U.S. Pat. App. Pub. No. 2009/0218560, filed Jan. 23, 2009, U.S. Pat. App. Pub. No. 2008/0200011, filed Jun. 14, 2007, U.S. Pat. App. Pub. No. 2009/0218560, Jan. 23, 2009, and U.S. Pat. App. Pub. No. 2010/0112305, Oct. 31, 2008, as well as in U.S. Pat. No. 7,713,835, filed Oct. 3, 2007, and U.S. Pat. No. 7,935,780, filed Jun. 25, 2008, and copending U.S. Ser. No. 12/819,680, filed Jun. 21, 2010, the disclosures of which are incorporated by reference herein in their entirety to the extent not inconsistent with the present application. It will be appreciated, however, that the order of assembling or applying the components to form the wafer stack will vary, and can be performed in any order or using any method suitable to achieving a stack comprising bonded substrates. It will also be appreciated that FIGS. 1-3 are provided by way of illustration only and do not represent the only type of wafer stacks suitable for use with the present invention.

After the desired processing has occurred, the first substrate 12 can be separated from the second substrate 14, as shown in FIG. 1(*b*). Various methods can be used to separate the bonded substrates 12, 14, as described above. For example, in one preferred embodiment, the first substrate 12 and second substrate 14 are separated by heating to a temperature sufficient to soften the bonding layer 24. In another preferred embodiment, instead of heating to soften the layer 24, the bonding material can be dissolved using the inventive cleaning composition itself. The cleaning composition of the invention can be used to dissolve the entire layer 24 of bonding material or only a portion thereof. Dissolution of the entire layer 24 of bonding material can be achieved by contacting the bonding layer 24 with the cleaning composition. The composition can be spin-applied, sprayed, or otherwise dispensed onto the outermost edge 26 of the layer 24, or the wafer stack 10 can be immersed in the cleaning composition. Contact with the composition is carried out until the layer 24 is sufficiently dissolved to facilitate separation of the substrates 12, 14. In general, the bonding material may be contacted with the cleaning solution for time periods of from about 30 seconds to about 12 hours, preferably from about 1 min. to about 60 min., more preferably from about 5 min. to about 30 min., and even more preferably from about 10 min. to about 20 min. Contact is preferably carried out at temperatures of from about 20° C. to about 80° C., more preferably from about 30° C. to about 60° C., and even more preferably from about 40° C. to about 50° C. The substrates 12, 14 can then be separated, and residual bonding material can be removed from the substrate(s) if necessary, as described below.

Figure 4:
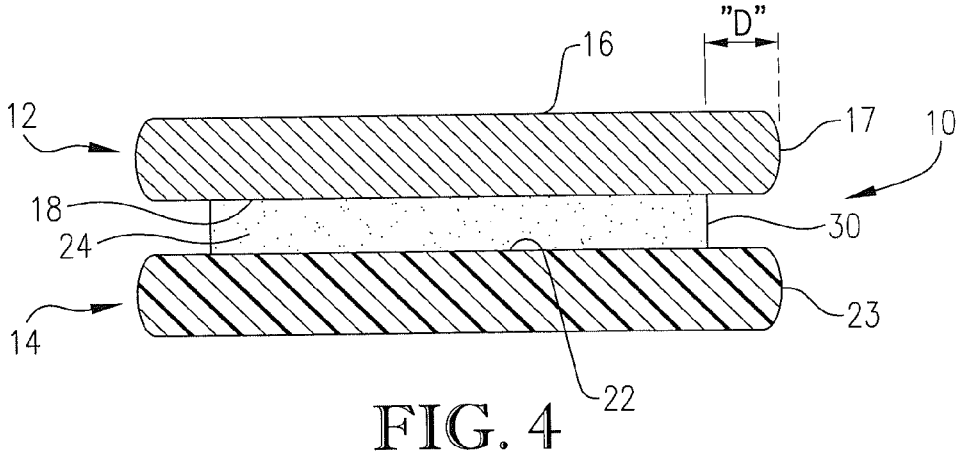
FIG. 4 is a schematic cross-sectional view of a wafer stack after edge removal.

In an alternative embodiment, the cleaning composition can be used to dissolve only a portion of the layer 24 of bonding material, such as only the outermost portion of the bonding layer 24, as shown in FIG. 4. This can be achieved by dispensing the cleaning composition only along the outermost edge 26 of the layer 24, using, for example, a spinning or spraying application method. This process is carried out until the desired portion of the layer 24 is removed, preferably for about 30 seconds to about 20 min., more preferably from about 1 min. to about 10 min., and even more preferably from about 2 min. to about 5 min. Alternatively, the wafer stack can be immersed into the cleaning composition for a specific period of time (typically from about 2 min. to about 120 min., more preferably from about 3 min. to about 20 min., and even more preferably from about 5 min. to about 10 min.) to dissolve only the outermost portion of the bonding layer 24. Regardless of the embodiment, the stack is then preferably rinsed and spun dry, as described below. Such edge removal can be used with any of the bonding/debonding methods described above, but is particularly suited for use with non-uniform bonding layers 24 as shown in FIGS. 2(*a*) and 3(*a*). FIGS. 2(*b*) and 3(*b*) depict the respective wafer stacks after edge removal.

Figure 2:
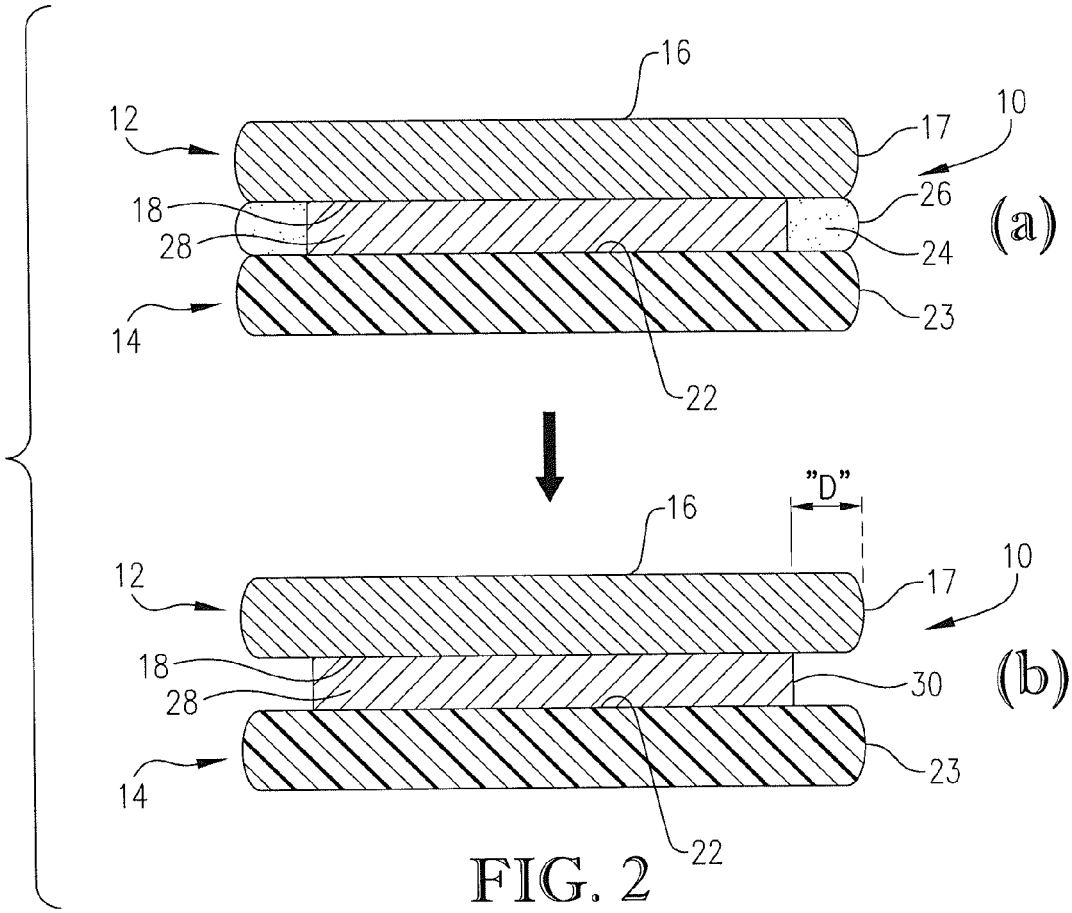
FIG. 2(*a*) is a schematic cross-sectional view of a further wafer stack embodiment of the invention.
Figure 3:
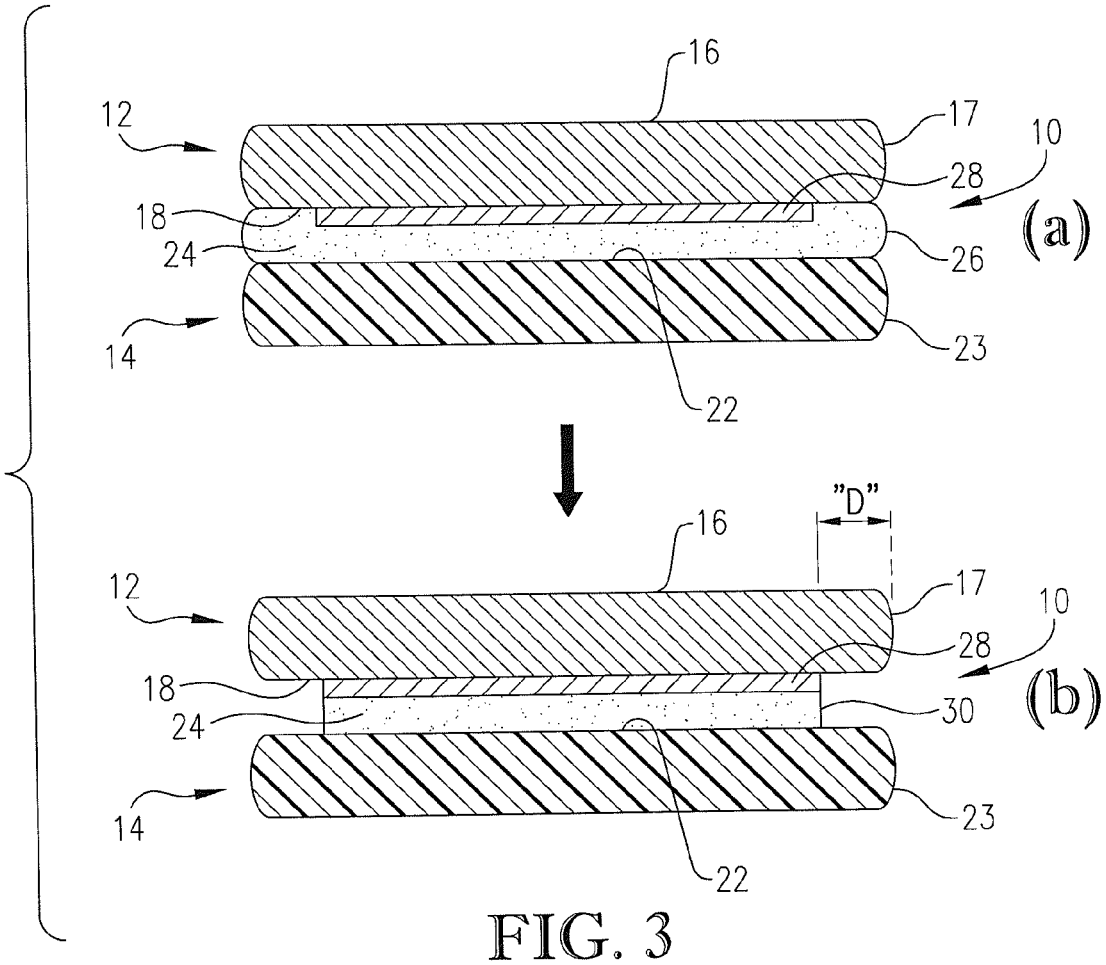
FIG. 3(*a*) is a schematic cross-sectional view of a further wafer stack embodiment of the invention.

In embodiments using edge removal, the bonding layer 24 or fill material 28, as the case may be, has an outermost edge 30, which is spaced a distance "D" from the plane defined by the outer edge 17 of the first substrate 12, as shown in FIGS. 2(*b*), 3(*b*), and 4. "D" is typically from about 0.05 mm to about 10 mm, more preferably from about 0.5 mm to about 5 mm, and even more preferably from about 1 mm to about 2.5 mm. It will be appreciated that contact with the cleaning composition can be maintained for a sufficient time to dissolve the desired amount of bonding material and/or fill material to achieve the desired distance "D."

Other removal processes include first mechanically disrupting or destroying the continuity of the outermost portion of the bonding layer 24 using laser ablation, plasma etching, water jetting, or other high energy techniques that effectively etch or decompose the edge. It is also suitable to first saw or cut through the outermost portion of the bonding layer 24 or cleave the layer 24 by some equivalent means. Regardless of which of the above means is utilized, the substrates 12, 14 can then be separated, preferably using a low mechanical force (e.g., finger pressure, gentle wedging) to slide, lift, peel, or otherwise remove the first substrate 12 from the second substrate 14. Tools and implements can also be used to facilitate separation, such as clamps, vacuum chuck, flexible chuck, adhesive film-covered chuck, and the like, which are known in the art.

It will be appreciated that the particular process used for separation will depend upon the chemical make-up of the bonding layer 24, as well as the physical configuration of the layer 24 (i.e., uniform vs. non-uniform). It will also be appreciated that the time required to sufficiently dissolve the bonding layer when using the cleaning composition of the invention will depend, to an extent, on the chemical composition of the bonding material and the methods used to apply it. Removal with the inventive cleaning compositions can also be used in combination with heat as described above and/or any other processes suitable for facilitating separation of the substrates.

Regardless of the process used to separate the substrates 12, 14, the debonded surfaces of the substrates will generally comprise residual bonding material 24', as shown in FIG. 1(*b*). Depending upon the method used to separate the substrates 12, 14, the residual bonding material 24' can be in the form of a layer on the substrate surface, or it can be in the form of bonding material residue. The term "residue" is used herein to refer to the presence of bonding material on the surface of the first substrate 12 and/or second substrate 14, wherein the bonding material covers less than 100% of the surface area of the substrate surface. In other words, the bonding material is not present as an intact layer adjacent the substrate surface, but covers only portions of the surface. The residual bonding material 24' can be cleaned from the first substrate 12 and/or second substrate 14 using the inventive cleaning composition. In general, this is accomplished by contacting the residual bonding material 24' on the substrate with the cleaning composition for a time period sufficient to dissolve away the material.

In one aspect, the substrate(s) can be cleaned by a spin application method. In this aspect, the cleaning composition is spin-applied continuously at about 200 to about 1,200 rpm (preferably about 300 to about 1,000 rpm, and more preferably about 300 to about 600 rpm) to the spinning substrate for about 1 to about 10 minutes (preferably about 1 to about 8 min., and more preferably about 2 to about 5 min.). Alternatively, the cleaning composition is spin-applied intermittently at about 200 to about 1,200 rpm (preferably about 300 to about 1,000 rpm, and more preferably about 500 to about 800 rpm) with a frequency of about 1 to about 6 cycles/min. (preferably about 1 to about 4 cycles/min., and more preferably about 1 to about 3 cycles/min.) for about 2 to about 5 minutes (preferably about 2 to about 4 min., and more preferably about 2 to about 3 min.). This is followed by spin-rinsing the substrate with a solvent at about 200 to about 1,200 rpm (preferably about 500 to about 1,000 rpm, and more preferably about 600 to about 900 rpm) for about 30 to about 60 seconds (preferably about 30 to about 50 seconds, and more preferably about 30 to about 40 seconds), and then spin drying rapidly at about 1,500 to about 2,000 rpm for about 30 to about 60 seconds (preferably about 30 to about 50 seconds, and more preferably about 30 to about 40 seconds). Suitable solvents for rinsing are selected from the group consisting of water, isopropanol, 1-dodecene, acetone, methanol, ethanol, and mixtures thereof. In a further aspect, the substrate(s) can be cleaned by a puddling method. In this aspect, the cleaning composition is puddled onto the substrate surface and allowed to remain for about 2 to about 120 seconds (preferably about 30 to about 90 seconds, and more preferably about 45 to about 60 seconds). The cleaning composition is then spun off at about 500 to about 2,000 rpm (preferably about 1,000 to about 2,000 rpm, and more preferably about 1,200 to about 1,500 rpm). This puddling and spinning cycle can be repeated until the residual material is dissolved away, usually about 1 to about 7 times (preferably about 3 to about 5 times). The substrate can then be rinsed with additional hydrocarbon solvent, followed by a final rinse with water, isopropanol, 1-dodecene, acetone, methanol, ethanol, or a mixture thereof. Preferably, the substrate is spin-rinsed with the hydrocarbon solvent at about 300 to about 1,000 rpm (preferably about 500 to about 800 rpm) for about 15 to about 60 seconds (preferably about 30 to about 45 seconds), followed by spin-rinsing with alcohol (preferably isopropanol) at about 300 to about 1,000 rpm (preferably about 300 to about 900 rpm, and more preferably about 500 to about 800 rpm) for about 15 to about 120 seconds (preferably about 15 to about 60 seconds, and more preferably about 15 to about 30 seconds). The substrate is then spun dry at about 1,500 to about 2,000 rpm for about 30 to about 60 seconds (preferably 15 to about 45 seconds, and more preferably about 15 to about 30 seconds).

Instead of puddling the cleaning composition onto the substrate, the surface of the substrate can be sprayed with the cleaning solution, followed by rinsing and drying as described above. In yet a further aspect, the residual bonding material can be removed from the surface of the substrate by immersing the substrate into cleaning composition. Preferably, the substrate is immersed into the cleaning composition for about 1 min. to about 10 min. (preferably about 1 min. to about 5 min., and more preferably about 2 min. to about 5 min.). Immersion can be repeated as needed until the bonding material is sufficiently dissolved. This can be followed by rinsing and drying the substrate as described above.

Preferably, at least about 99.99% of the material is removed by the cleaning composition, more preferably at least about 99.999% of the material is removed, and even more preferably at least about 99.9999% of the material is removed from the substrate by the cleaning composition. When scanned with a wafer surface inspection tool, such as a Surfscan (available from KLA-Tencor), the cleaned substrate will preferably have less than about 10,000 particles per wafer, more preferably less than about 5,000 particles per wafer, and even more preferably less than about 2,000 particles per wafer, based upon a 12-inch wafer. The cleaned substrate(s) can then be subjected to further processing (in the case of device wafers) or reused (in the case of carrier wafers).

EXAMPLES

The following examples set forth methods in accordance with the invention. It is to be understood, however, that these examples are provided by way of illustration and nothing therein should be taken as a limitation upon the overall scope of the invention.

Example 1

Wafer Cleaning with Inventive Cleaning Solution

1. Preparation of Cleaning Solution Formulation A

To prepare a cleaning solution, 28.6 grams of 70% dodecylbenzenesulfonic acid in isopropanol (Aldrich, Milwaukee, Wis.) were dissolved in 171.4 grams of 1-dodecene (General Chemical, Parsippany, N.J.). The solution was stirred with a magnetic stir bar for more than 30 minutes and then filtered through a 0.1-μm PTFE membrane filter to yield Formulation A.

2. Adhesive Coating on 4-Inch Silicon Wafers

A wafer coated with bonding adhesive was prepared by spin coating WaferBOND® HT-10.10 bonding material (Brewer Science Inc., Rolla Mo.) onto a 4-inch silicon wafer at 1,000 rpm for 30 seconds. The wafer was then baked at 110° C. for 2 minutes and 160° C. for 2 minutes.

3. Wafer Cleaning with Formulation A

Formulation A was puddled onto the prepared wafer coated with bonding material for 60 seconds. The solution was then spun off at 2,000 rpm for 10 seconds. This puddling and spinning cycle was repeated twice for a total of three times. The wafer was then spin-rinsed with 1-dodecene at 200 rpm for 15 seconds followed by isopropanol at 300 rpm for 15 seconds. The wafer was finally spun dry at 2,000 rpm for 30 seconds, and then examined under an optical microscope. It was observed to be clean without particles, indicating near complete removal of the bonding material.

Comparative Example 1

Wafer Cleaning with 1-Dodecene

An adhesive-coated wafer was prepared by spin coating WaferBOND® HT-10.10 bonding material (Brewer Science Inc., Rolla Mo.) onto a 4-inch silicon wafer at 1,000 rpm for 30 seconds. The wafer was then baked at 110° C. for 2 minutes and 160° C. for 2 minutes. The coated wafer was then cleaned with filtered 1-dodecene using the same cleaning process described in Example 1. The wafer was then examined under an optical microscope and observed to be dirty with many particles, indicating an incomplete removal of the bonding material.

Example 2

Wafer Cleaning with Additional Cleaning Solutions

1. Preparation of Cleaning Solutions

A. Formulation B

To prepare cleaning solution Formulation B, 200 grams of Bio-Soft S-101 (97% linear alkylbenzenesulfonic acid from Stepan Company, Northfield, Ill.) were dissolved in 200 grams of isopropanol. Next, 3,600 grams of mesitylene were added slowly to the solution with vigorous stirring. After the addition, the resulting solution was stirred for more than 30 minutes, and then filtered through a 0.1-μm PTFE membrane filter.

B. Formulation C

To prepare cleaning solution Formulation C, 200 grams of Bio-Soft S-101 were dissolved in 200 grams of 1-butanol. Next, 3,600 grams of 1-dodecene were added slowly to the solution with vigorous stirring. After the addition, the resulting solution was stirred for more than 30 minutes, and then filtered through a 0.1-μm PTFE membrane filter.

C. Formulation D

To prepare cleaning solution Formulation D, 200 grams of Bio-Soft S-101 were dissolved in 200 grams of 1-butanol. Next, 3,600 grams of mesitylene were added slowly to the solution with vigorous stirring. After the addition, the resulting solution was stirred for more than 30 minutes, and then filtered through a 0.1-μm PTFE membrane filter.

2. Adhesive Coating on 12-inch Silicon Wafers

Coated wafers were prepared by spin coating WaferBOND® HT-10.10 bonding material onto 12-inch silicon wafers at 1,500 rpm for 60 seconds. The wafers were then baked at 110° C. for 2 minutes and 180° C. for 2 minutes.

3. Cleaning with Formulations B-D

Formulations B was spin applied to two adhesive-coated wafers, prepared above, at 900 rpm for 5 minutes. The wafers were then spin-rinsed with isopropanol at 900 rpm for 1 minute, followed by spin drying at 2,000 rpm for 60 seconds. The two wafers were then scanned under a Surfscan SP1 (KLA-Tencor). The particle count at above 0.5 μm defect sensitivity was found to be 13,767 for one wafer and 7,532 for the other wafer, resulting in an average particle count of 10,650.

The above process was repeated with Formulations C and D. The average particle count for Formulation C was found to be 10,177, while the average particle count for Formulation D was found to be 13,548.

Comparative Example 2

Wafer Cleaning with 1-Dodecene

Two WaferBOND® HT-10.10-coated wafers prepared as in Example 2 were cleaned with filtered 1-dodecene by applying the 1-dodecene to the coated wafers at 900 rpm for 5 minutes. The wafers were then spin-rinsed with isopropanol at 900 rpm for 1 minute, followed by spin drying at 2,000 rpm for 60 seconds. Next, the wafers were scanned under a Surfscan SP1. The particle count at above 0.5 μm defect sensitivity was found to be 85,115 for one wafer and 86,030 for the other wafer, with an average of 85,572.

We claim:

1. A method of removing a bonding material from a substrate surface, said method comprising:

providing a first substrate having a surface with the bonding material thereon; and contacting said bonding material with a cleaning composition to thereby remove at least a portion of said bonding material from said substrate surface, said cleaning composition comprising an alkylarylsulfonic acid and from about 2 to 15% by weight of an aliphatic alcohol, based upon the total weight of the composition taken as 100% by weight, dispersed or dissolved in a hydrocarbon solvent system, wherein said aliphatic alcohol is selected from the group consisting of ethanol, 1-propanol, 2-propanol, 1-butanol, 2-butanol, 2-methyl-1-propanol, 2-methyl-2-propanol, allyl alcohol, 2-butyn-1-ol, 3-butyn-1-ol, 3-butyn-2-ol, 3-buten-1-ol, 3-buten-2-ol, 1-pentanol, 2-pentanol, 1-hexanol, and mixtures thereof.

2. The method of claim 1, wherein at least about 99.99% of said bonding material is removed by said contacting.

3. The method of claim 1, where said first substrate is a microelectronic substrate.

4. The method of claim 3, wherein said first substrate is selected from the group consisting of microelecfromechanical system (MEMS) devices, display devices, flexible substrates, compound semiconductors, low k dielectric layers, dielectric layers, ion implant layers, and substrates comprising silicon, aluminum, tungsten, tungsten silicide, gallium arsenide, germanium, tantalum, tantalum nitrite, SiGe, and mixtures of the foregoing.

5. The method of claim 3, wherein said first substrate surface comprises an array of devices selected from the group consisting of integrated circuits, MEMS, mierosensors, power semiconductors, light-emitting diodes, photonic circuits, interposers, embedded passive devices, and microdevices fabricated on or from silicon and other semiconducting materials selected from silicon-germanium, gallium arsenide, or gallium nitride.

6. The method of claim 3, said first substrate surface comprising at least one structure selected from the group consisting of: solder bumps; metal posts; metal pillars; and structures formed from a material selected from the group consisting of silicon, polysilicon, silicon dioxide, silicon (oxy)nitride, metal, low k dielectrics, polymer dielectrics, metal nitrides, and metal silicides.

7. The method of claim 1, wherein said first substrate comprises a material selected from the group consisting of silicon, sapphire, quartz, metal, glass, ceramic, and glass-ceramic composite.

8. The method of claim 1, wherein said contacting is selected from the group consisting of immersing said substrate in said cleaning composition, spraying said cleaning composition onto said bonding material, puddling said cleaning composition onto said bonding material, and spin-applying said cleaning composition onto said bonding material.

9. The method of claim 1, wherein said contacting is carried out for a time period of from about 30 seconds to about 12 hours.

10. The method of claim 1, further comprising rinsing said first substrate surface with a solvent selected from the group consisting of water, isopropanol, 1-dodecene, acetone, methanol, ethanol, and mixtures thereof.

11. The method of claim 10, further comprising repeating said contacting step after said rinsing.

12. The method of claim 1, wherein said first substrate is bonded to a second substrate by said bonding material.

13. The method of claim 12, further comprising separating said first and second substrates.

14. The method of claim 13, wherein said first substrate after said separating has a surface comprising residue of said bonding material, further comprising contacting said surface with said cleaning composition to remove said residue.

15. The method of claim 12, wherein said second substrate is bonded to said first substrate via a layer of said bonding material, said layer of bonding material comprising an outermost edge, wherein said contacting comprises contacting said outermost edge with said cleaning composition to effect edge removal of at least a portion of said bonding material layer,

16. The method of claim 12, wherein said second substrate is bonded to said first substrate via a layer of said bonding material, and wherein said contacting is carried out for sufficient time to substantially dissolve the entire bonding material layer.

17. The method of claim 12, wherein said providing comprises:

applying said bonding material to at least one of said first and second substrates; and contacting said substrates with one another so as to bond said substrates together.

18. The method of claim 12, wherein:

said first substrate has a device surface comprising a plurality of topographical features, and said bonding material is bonded to said device surface; and said second substrate comprises a bonding surface that is bonded to said bonding material.

19. The method of claim 1, wherein said cleaning composition comprises from about 2 to about 15% by weight alkylarylsulfonic acid, based upon the total weight of the composition taken as 100% by weight.

20. The method of claim 1, wherein said alkylarylsulfonic acid is selected from the group consisting of $C_6$-$C_{18}$ alkylarylsulfonic acids and mixtures thereof.

21. The method of claim 1, wherein said alkylarylsulfonic acid is an alkylbenzenesulfonic acid.

22. The method of claim 21, wherein said alkylbenzenesulfonic acid is selected from the group consisting of hexylbenzenesulfonic acid, heptylbenzenesulfonic acid, octyl benzenesulfonic acid, decylbenzenesulfonic acid, dodecylbenzenesulfonic acid, tridecylbenzenesulfonic acid, tetradecylbenzenesulfonic acid, hexadecylbenzenesulfonic acid, octadecylbenzenesulfonic acid, and mixtures thereof.

23. The method of claim 1, wherein said contacting is carried out at temperatures of from about 20° C. to about 80° C.

* * * * *